US005082157A

United States Patent [19]

Emerson-Santos

[11] Patent Number: 5,082,157

[45] Date of Patent: Jan. 21, 1992

[54] EASILY ACCESSIBLE CONCEALED POCKET

[76] Inventor: Marla Emerson-Santos, 46222 Fonner Ct. West, Northville, Mich. 48107

[21] Appl. No.: 637,187

[22] Filed: Jan. 3, 1991

[51] Int. Cl.[5] ..... A45C 1/04; A45F 5/00

[52] U.S. Cl. ..... 224/229; 224/253; 224/224; 224/226

[58] Field of Search ..... 224/253, 224, 226, 229, 224/192, 195

[56] References Cited

U.S. PATENT DOCUMENTS

| | | | |
|---|---|---|---|
| 974,226 | 11/1910 | West | 224/252 |
| 3,158,300 | 11/1964 | Withee | 224/253 |
| 3,379,349 | 4/1968 | Hier | 224/253 |
| 3,565,303 | 2/1971 | Kippen | 224/253 |
| 3,982,675 | 9/1976 | Claypool | 224/252 |
| 4,174,798 | 11/1979 | Pollard | 224/253 |
| 4,416,315 | 11/1983 | Foley | 150/47 |
| 4,749,113 | 6/1988 | Grubman | 224/229 |

FOREIGN PATENT DOCUMENTS

| | | | |
|---|---|---|---|
| 1168796 | 3/1957 | France . | |
| 2158346 | 11/1985 | United Kingdom | 224/253 |

*Primary Examiner*—Henry J. Recla
*Assistant Examiner*—Keith Kupferschmid
*Attorney, Agent, or Firm*—Dykema Gossett

[57] ABSTRACT

A concealed pocket comprises a container and a belt loop. A belt passes through the belt loop and the container portion has a pocket opening which is vertically aligned with the belt loop and the belt. The pocket is received between an article of clothing and the wearer such that the belt forces the article of clothing inwardly against the wearer to close the pocket opening. In this way, the pocket is concealed within the article of clothing. When it is desired to remove valuables from the container, the wearer merely moves the belt outwardly, and has access to the container.

6 Claims, 1 Drawing Sheet

EASILY ACCESSIBLE CONCEALED POCKET

BACKGROUND OF THE INVENTION

This application relates to a device for concealing valuables. More particularly, this application relates to such a device that allows easy removal.

Various prior art devices are known for concealing valuables. Such concealment devices are beneficial to travelers or others carrying large amounts of cash or valuables. These concealment devices allow a wearer to conceal valuables in a location that is not readily accessible to a thief.

U.S. Pat. No. 4,416,315 discloses a device for concealing valuables that is clipped to a garment. A container portion receives valuables and is placed between the garment and a wearer, such that it is concealed. Such a device does adequately conceal valuables, but the valuables typically cannot be removed without fully removing the container from within the garment. Further, a zipper closes the container and thus makes the valuables even less accessible.

U.S. Pat. No. 4,749,113 discloses another prior art device which includes a belt-like member having containers received within an article of clothing to conceal valuables. These containers are closed with a zipper, and valuables hidden within the container may not be removed without fully removing the container from within the article of clothing.

The above-described prior art devices provide some benefits in that they do allow the concealment of valuables. Even so, they do not enjoy widespread use. One main reason may be that they are burdensome to use. A wearer typically must remove the container from within an article of clothing to remove any valuables within the container. Not only is this burdensome, but a thief observing the wearer when the container is removed would be given an indication of the location of the concealed valuables. This is of course undesirable and defeats one main purpose of such concealment devices. Further, some thieves will use a razor to cut such members from the wearer. Once cut, the members could fall from the garment and to the ground.

United Kingdom Patent Application 2,158,346 discloses a pouch having belt loops which may receive valuables in a container. This pouch is closed by a zipper and may be worn on the outside of an article of clothing. As such, the container does not conceal valuables.

U.S. Pat. No. 4,174,798 and French reference 1,168,796 both disclose pocket members having a belt loop to receive a belt and mount the pocket to an article of clothing. The opening to the disclosed pockets appears to be readily accessible to a wearer. Neither of these references disclose the pocket received within the article of clothing, and thus, these references do not conceal valuables.

In summary, the prior art concealment devices do not allow valuables to be readily removed from a container portion. Although the prior art does disclose devices which allow easy access to stored valuables, these devices do not typically conceal the valuables.

SUMMARY OF THE INVENTION

It is an object of the present invention to disclose a readily accessible concealed pocket that stores valuables, and also allows those valuables to be easily removed without removing the pocket from within an article of clothing.

In a disclosed embodiment of the present invention, a pocket has a pocket opening leading into a container portion for receiving valuables. The pocket also has a belt loop and is used in combination with a standard belt. The belt is received in the belt loop on the pocket with the container portion and pocket opening extending inwardly away from an inside face of the belt.

The pocket opening, the belt loop and the belt are all at least partially vertically aligned when worn by a wearer such that the belt holds the pocket opening against the wearer to provide a resilient closure. A wearer merely needs to pull the belt outwardly away from his body, and the pocket opening is readily accessible for storage or removal of valuables. Thus, a wearer may remove valuables without fully removing the securement device. To an observer, this action may appear to be nothing more than removing money from a pants pocket.

In a preferred embodiment of the present invention the pocket is formed by a polygonal inner member having a first plurality of sides and a polygonal outer member having the same plurality of sides. The inner and outer members are secured to each other at all but one of the plurality of sides, with the unsecured side defining a pocket opening leading into a container defined by the secured sides.

The unsecured side of the outer member preferably extends beyond the unsecured side of the inner member, and is secured to an outer face of the outer member to define the belt loop. In a most preferred embodiment of the present invention, the belt loop is defined by the unsecured end of the outer member being secured to an outer face of the outer member at a first position approximately aligned with the unsecured end of the inner member. The belt loop is then folded outwardly such that it overlies the outer face of the outer member, and such that the belt loop is aligned with the pocket opening. A channel is defined between the belt loop and the outer face of the outer member. This channel is received over an article of clothing such that the container is concealed within the article of clothing.

In other aspects of the present invention, the belt also supports an article of clothing. Further, the belt loop may preferably be the same color as the article of clothing. The article of clothing is disclosed as a pair of pants, although the teachings of this invention would extend to other articles of clothing, such as skirts. Further, the pocket is preferably formed of a fabric such that it comfortably conforms to the shape of a wearer.

In a method according to the present invention, valuables are concealed by forming a pocket having a container, with a pocket opening and a belt loop as described above. A belt is passed through the belt loop, which also secures an article of clothing to a wearer. The pocket is received between the article of clothing and the wearer. The loop, the opening and the belt are preferably vertically aligned such that the belt provides a resilient closure for the pocket opening. In this way, the belt may be moved outwardly away from the wearer to allow access to the pocket opening and container.

These and other objects and features of the present invention can be best understood from the following specification and drawings, of which the following is a brief description.

DETAILED DESCRIPTION OF A PREFERRED EMBODIMENT

Figure 1:
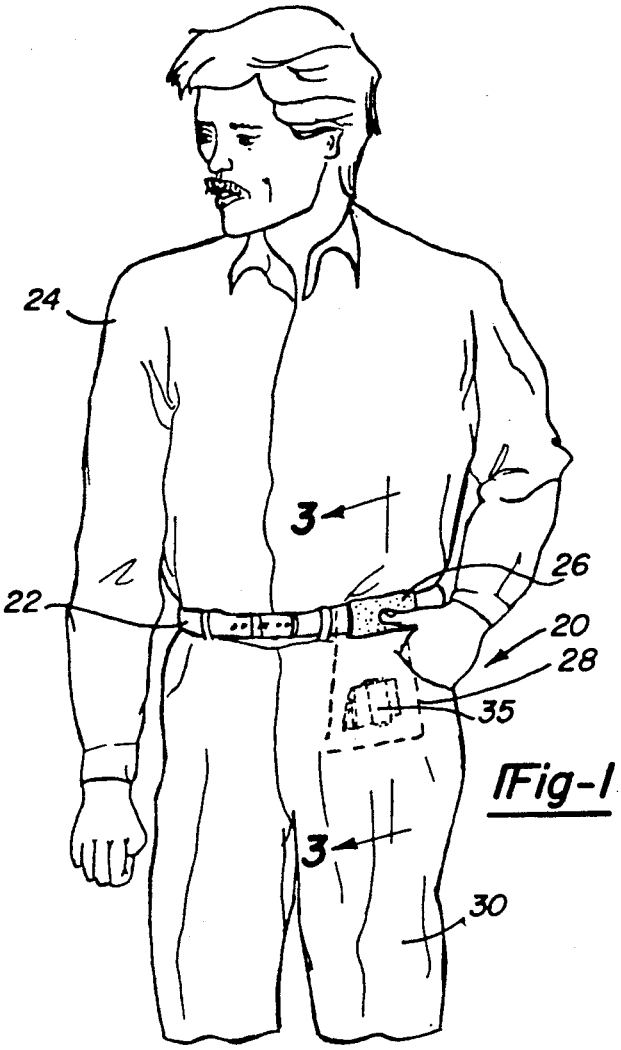
FIG. 1 is a perspective view showing a wearer with a pocket according to the present invention.

FIG. 1 shows a security pocket 20 carried on belt 22 worn by wearer 24. Belt 22 passes through a loop 26 attached to pocket 20 to carry the pocket. Container portion 28 is received within pants 30 worn by wearer 24, such that valuables 32 received within container 28 are concealed. Although pants 30 are illustrated, it should be understood that the teachings of this invention extend to other articles of clothing, such as skirts.

Pocket 20 is worn on the front of the wearers leg in the crotch area. It is unlikely that a thief could remove pocket 20 without wearer 24 gaining some notice. Further, a thief may attempt to use a razor blade in an attempt to cut loop 26 and free pocket 20 from belt 22 to cause it to fall to the ground. With the inventive arrangement, belt 22 continues to hold pocket 22 to wearer 24, as will be explained below.

Loop 26 may preferably be formed of a color similar to that of pants 30. In this way, loop 26 is less visible, and an observer is less likely to notice pocket 20. Alternatively, wearer 24 may wear a shirt outside of belt 22 to conceal loop 26. Although one of the two above described methods of concealing the existence of loop 26 are preferably used, they are not necessary. Thieves may avoid those who utilize a concealment device even if they are aware of it. These concealment devices make theft of valuables more difficult than valuables stored in a conventional wallet or purse. Thieves may have enough potential victims who carry valuables in wallets or purses, and may not bother with those which wear concealment devices.

Figure 2:
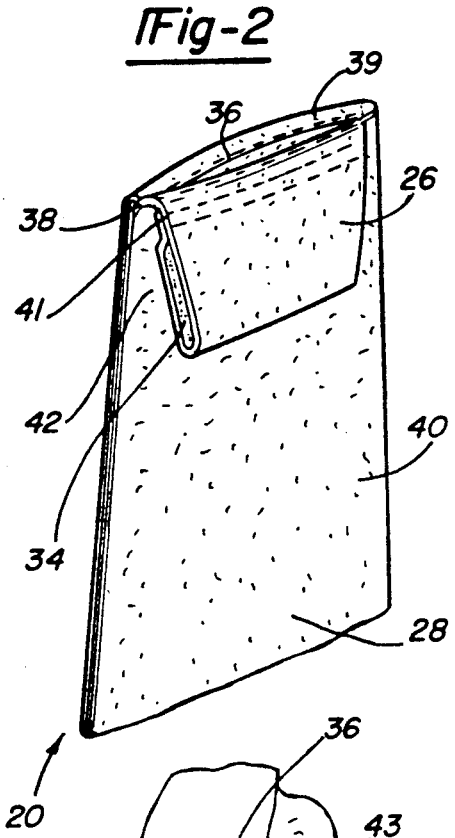
FIG. 2 is a perspective view of the pocket illustrated in FIG. 1.

FIG. 2 is a perspective view of pocket 20 having loop 26 forming belt opening 34. Pocket opening 36 leads into container 28 which actually receives valuables 32. Loop 26 is bent downwardly about a top point 38 away from inner member 39 such that it overlies an outer face of outer member 40. Channel 42 is defined between loop 26 and the outer face of front member 40.

Inner member 39 and outer member 40 each have four sides and are secured together at three sides. The fourth side is left unsecured to define pocket opening 36. The sides may be secured by sewing. Outer member 40 has an unsecured end extending beyond the unsecured end of inner member 39. The unsecured end of outer member 40 is doubled back upon itself and sewn at hem 41 to an outer face of outer member 40 to define loop 26. Hem 41 is preferably slightly above the unsecured end of inner member 39 and opening 36. Loop 26 is folded downwardly from point 38 such that it overlies the outer face of outer member 40 and defines channel 42.

Figure 3:
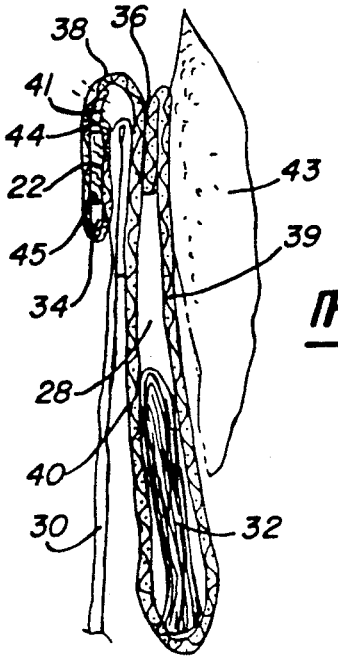
FIG. 3 is a cross-sectional view along line 3—3 as shown in FIG. 1.

FIG. 3 is a cross-sectional view along line 3—3 as illustrated in FIG. 1. Belt loop 26 is folded about point 38 such that it is received outwardly of outer face 40, and receives belt 22.

Channel 42 is received over an uppermost portion of pants 30, and container 28 is received within pants 30. Pocket opening 36 is vertically aligned, or in side-by-side relationship, with belt opening 34 and belt 22 such that when belt 22 is tightened to secure pants 30, belt 22 presses pocket opening 36 against the body 43 of wearer 24 to close pocket opening 36. In this way, container 28 is resiliently closed to conceal valuables 32.

Belt 22 has upper end 44 and lower end 45. Belt loop 26 receives belt 22 and extends beyond the upper end 44 and lower end 45 of belt 22. Further, pocket opening 36 is aligned with belt loop 26 and belt 22. Belt top end 44 holds outer face 40 against inner face 39 at pocket opening 36 to provide a closure. As illustrated in this figure, belt 22 may not actually be vertically aligned with the top of the unsecured end of inner face 39. In a case such as illustrated, the actual closure, or opening 36 to container 28 would be defined at a vertical location equal to the top end 44 of belt 22. When this requirement is met, then opening 36 is easily accessible to wearer 24 for removal of valuables 32.

Should a thief use a razor to cut loop 26, container 28 will not fall to the ground. Instead, belt 22 continues to hold outer member 40 and inner member 39 against body 43 of wearer 24. This, in combination with the placement of pocket 20 in a relatively sensitive area of wearer 24 makes it unlikely that a thief would be able to obtain pocket 20 in this way.

Figure 4:
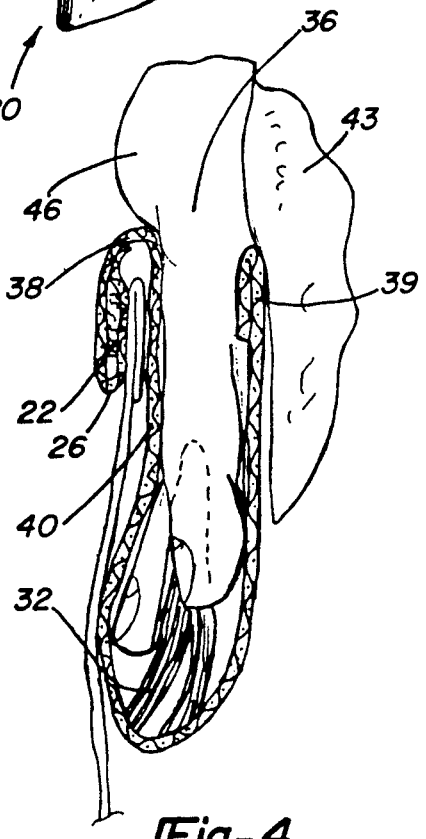
FIG. 4 is a view similar to FIG. 3, but showing the removal of valuables from the pocket.

As illustrated in FIG. 4, when it is desired to remove valuables 32 from pocket 20, wearer 24 merely inserts hand 46 into pocket opening 36 which forces belt 22 outwardly away from body 43. To an observer, this removal may seem like nothing more than merely removing money from a standard pocket.

In a method according to the present invention, pocket 20 is formed having pocket opening 36 to container 28, and belt loop 26, wherein belt loop 26 and pocket opening 36 are vertically aligned. Belt 22 is received within belt loop 26 and also secures an article of clothing to wearer 24. Container portion 28 of pocket 20 is received between the article of clothing and wearer. Since belt loop 26 and pocket opening 36 are vertically aligned, belt 22 provides a resilient closure for pocket opening 36. When it is desired to remove valuables from the pocket, the wearer merely inserts hand 46 into pocket opening 36 and forces belt 22 outwardly to provide access to container portion 28.

Although preferred embodiments of the present invention have been disclosed, it should be understood that a worker of ordinary skill in the art would be aware of certain modifications which would come within the scope of this invention. For this reason, the following claims should be studied in order to determine the true scope and content of the present invention.

I claim:

1. A security pocket combination comprising:

a pocket defined by a polygonal inner member having side edges and a polygonal outer member having side edges, said inner and outer members being secured to each other at all but one of said side edges to form a pocket, said unsecured edges defining a pocket opening said outer member further having an extension beyond said unsecured side edge of said outer member and being folded over and secured to an outer face of said extension facing away from said inner member to define a belt loop, said belt loop further being in overlapping relation with said outer member;

a belt having inner and outer surfaces and formed of an elongate member having ends secured to each other to define a continuous member for supporting an article of clothing, said belt received in said belt loop with said inner surface facing said pocket whereby said belt and said unsecured edges are in side-by-side relationship, such that said belt biases said unsecured edge of said outer member towards said unsecured edge of said inner member to provide a resilient closure.

2. A combination as recited in claim 1, wherein a channel is defined between said belt loop and said outer member.

3. A combination as recited in claim 2, wherein said belt also supports an article of clothing, and a portion of said article of clothing extends upwardly into said channel.

4. A combination as recited in claim 1, wherein said belt loop is the same color as said article of clothing.

5. A combination as recited in claim 1, wherein said pocket is formed of fabric.

6. The combination as recited in claim 1, wherein said extension and said outer member are formed integrally, as a single planar member.

* * * * *